US006117011A

United States Patent [19]

Lvov

[11] Patent Number: 6,117,011

[45] Date of Patent: Sep. 12, 2000

[54] ELECTRONIC GAME SYSTEM, METHOD OF MANAGING AND REGULATING SAID SYSTEM

[76] Inventor: Denis Ernestovich Lvov, 50 Marshal Bluher Ave., Apt. 197, St. Petersburg, Russian Federation, 195067

[21] Appl. No.: 09/000,321

[22] PCT Filed: Nov. 10, 1995

[86] PCT No.: PCT/RU95/00241

§ 371 Date: Jan. 27, 1998

§ 102(e) Date: Jan. 27, 1998

[87] PCT Pub. No.: WO97/05557

PCT Pub. Date: Feb. 13, 1997

[51] Int. Cl.[7] ..... A63F 9/22

[52] U.S. Cl. ..... 463/25; 463/29; 463/40; 463/42; 463/43; 364/410.1; 364/411.1; 364/138; 364/146

[58] Field of Search ..... 463/25, 29, 40, 463/42, 43; 364/410.1, 411.1, 138, 146; 340/323 R, 825.31; 273/148 B

[56] References Cited

U.S. PATENT DOCUMENTS

| | | |
|---|---|---|
| 4,467,424 | 8/1984 | Hedges et al. . |
| 4,494,197 | 1/1985 | Troy et al. . |
| 4,894,774 | 1/1990 | McCarthy et al. . |
| 4,900,027 | 2/1990 | Sheridan . |
| 4,910,677 | 3/1990 | Remedio et al. . |

(List continued on next page.)

FOREIGN PATENT DOCUMENTS

| | | |
|---|---|---|
| 0387862 | 3/1990 | European Pat. Off. . |
| 0477775 | 9/1991 | European Pat. Off. . |
| 2666672 | 3/1992 | France . |
| 3-70993 | 11/1991 | Japan . |
| 3-70994 | 11/1991 | Japan . |
| 9320526 | 10/1993 | WIPO . |

OTHER PUBLICATIONS

A.S. Klestchev et al., "Systems for Problem–Oriented Knowledge Representation," *Izvestiya AN SSSR.*, No. 5, 1982, pp. 43, 60–61.

(List continued on next page.)

*Primary Examiner*—Lee Young
*Assistant Examiner*—Binh-An Nguyen
*Attorney, Agent, or Firm*—Price, Heneveld, Cooper, DeWitt & Litton

[57] ABSTRACT

An electronic gaming system is disclosed that includes a central computer station, a plurality of peripheral computer stations, and a data exchange network for coupling the peripheral computer stations to the central computer station. The central computer station includes an administrative subsystem, a player's registration subsystem, a game accounts managing subsystem, an information tabulating, storing and searching subsystem, a game recording subsystem, a scoring subsystem, a wagering and betting subsystem, an executive gaming subsystem, an electronic payment subsystem, an information protection subsystem, a secure communications subsystem, and a game selection subsystem. Each of the peripheral computer stations include a subsystem for admitting and registering players with the central computer station and a gaming interface subsystem. To ensure security of the electronic gaming system, a player seeking to enter the system transmits an encoded message from their peripheral computer station to the central computer station that includes a set of key attributes associated with the player. The central computer station decodes and compares the transmitted set of key attributes with individual information previously stored in the information protection subsystem in order to identify each player during registration based upon the set of key attributes transmitted by each player. The system may automatically control money transactions with each player's bank accounts based upon the player's scoring and wagers in each selected game.

11 Claims, 6 Drawing Sheets

U.S. PATENT DOCUMENTS

| | | | |
|---|---|---|---|
| 4,918,603 | 4/1990 | Hughes et al. . | |
| 4,926,327 | 5/1990 | Sidley . | |
| 4,958,835 | 9/1990 | Tashiro et al. . | |
| 4,998,199 | 3/1991 | Tashiro et al. . | |
| 5,038,022 | 8/1991 | Lucero . | |
| 5,083,800 | 1/1992 | Lockton . | |
| 5,359,510 | 10/1994 | Sabaliauskas . | |
| 5,404,524 | 4/1995 | Celi, Jr. | 395/700 X |
| 5,421,590 | 6/1995 | Robbins | 273/438 X |
| 5,586,257 | 12/1996 | Perlman | 463/42 X |
| 5,609,525 | 3/1997 | Ohno et al. | 463/43 X |
| 5,624,316 | 4/1997 | Roskowski et al. | 463/45 X |
| 5,636,209 | 6/1997 | Perlman | 370/281 X |

OTHER PUBLICATIONS

S.P. Botuz, "Methods and Means for Representation of Multi–dimensional Parametric Dependencies," *The Book of Scientific Works/Information Technologies of Artificial Intelligence*, Moscow, 1994.

N.T. Rustamov et al., "Description of Tools for Constructing Advising Identification Systems," *Kibernetica*, Academy of Sciences, Tashkent, 1991.

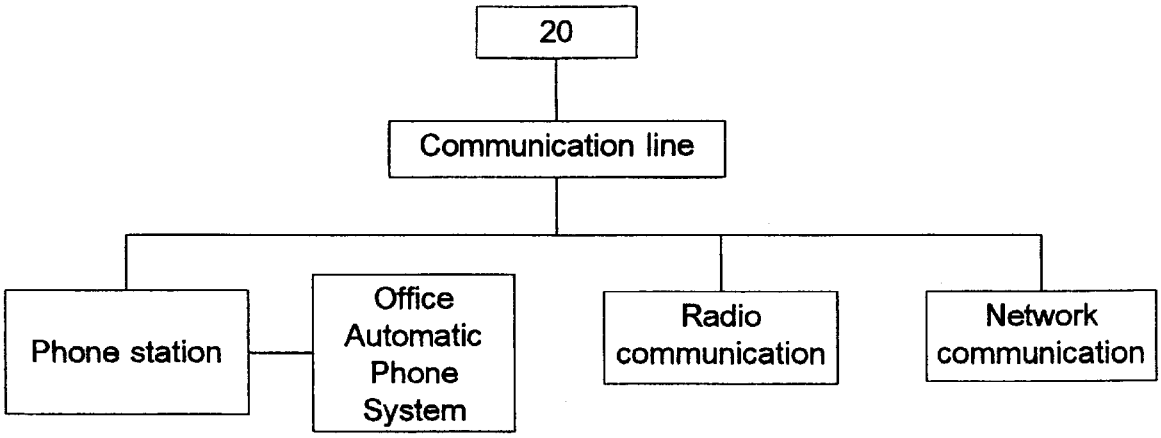
FIG.3.
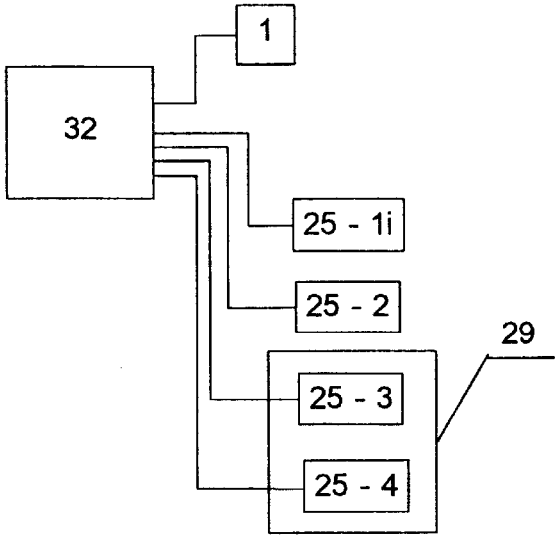
FIG.4
Please Enter
Pseudonym: *Alexsander*
Password: *Putnik239kros*
Kode: *45AV796*
FIG.5

Users statistics

| N | Users | General Rating | Rating of "Покер" | Rating of "Очко" | Rating of "Рулетка" |
|---|---|---|---|---|---|
| 1 | Alexander | 78 | 34 | 66 | 12 |
| 2 | Boris Sergeevich | 63 | 36 | 56 | 22 |
| 3 | Victor | 61 | 34 | 56 | 22 |
| 4 | Dmitry | 45 | 12 | 71 | 2 |
| 5 | Ivan | 45 | 12 | 71 | 2 |
| 6 | Pal Palych | 5 | 3 | 7 | 24 |

FIG.8

| N | Users | Rating of "Покер" |
|---|---|---|
| 1 | Victor | 34 |
| 2 | Ivan | 12 |
| 3 | Pal Palych | 3 |

FIG.9

| N | Users | Score | Current account |
|---|---|---|---|
| 1 | Alexander | 45 | 345786 |
| 2 | Boris Sergeevich | -4 | ---------- |
| 3 | Victor | 8 | ---------- |
| 4 | Dmitry | 3 | ---------- |
| 5 | Ivan | -20 | ---------- |
| 6 | Pal Palych | -32 | ---------- |

FIG.10

ELECTRONIC GAME SYSTEM, METHOD OF MANAGING AND REGULATING SAID SYSTEM

FIELD OF THE INVENTION

The invention relates to electronic games and service systems used in local and global networks for establishing casinos, in administrative and production systems, as well as in stock exchange systems and other communications and marketing systems requiring their parts to interact.

DESCRIPTION OF THE PRIOR ART

The patent "Multi-player type video game playing system " (EP, A1, 0387862, Sep. 9, 1990) is known that describes a playing system consisting of a cylinder-shaped screen with several radially arranged projectors. Each of the projectors is directed at a specific section of the screen. Several player's operating sections are arranged radially toward the screen. The sections, however, can be locally arranged around only one processor and do not provide for connecting service companies to the system as its subjects.

Gaming sets of equipment for gaming centers are known (JP, B, 3-70993, Nov. 11, 1991 and JP, B, 3-70994, Nov. 11, 1991) that are designed for playing on several group-forming gaming machines with a possibility of settling game accounts for games with several players. They, however, do not permit establishing of a protected network that is not limited by distance and that provides for a possibility of serving several companies and/or players belonging to the system (possibility of money transactions included) at a diversity of the game basis for wagering, betting and other game events.

Electronic settlement of accounts via networks that provide communications with financial institutions is known, for instance, "Apparatus and method for providing credit for operating a gaming machine " (U.S. Pat. No. 5,038,022, Aug. 6, 1991) and "Installation permettant de participer à distance et en direct à des jeux de casino" (FR, A1, 2666672, Mar. 13, 1992). They, however, do not permit establishing of a geographically unlimited gaming system consisting of a plurality of subjects that envisages a simultaneous modeling of the gaming situation and settling the accounts by the results of the game through a financial institution. Patents "A communication terminal used as a game machine " (EP, A2, 0477775, Jan. 4, 1992) and "Game of skill or chance playable by several participants remote from each other in conjunction with a common event " (U.S. Pat. No. 5,083, 800, Jan. 28, 1992) are known that use telephone lines and terminals. The authors, however, did not envisage establishing of a protected network with service possibilities, including that of money transactions, on a broad gaming basis with various combinations of playing teams.

The patent "Game playing system " (U.S. Pat. No. 4,958, 835, Sep. 25, 1990) is known that describes a system with a plurality of gaming machines interconnected by a communications channel that enables them to exchange data using an identification code for each machine. Upon each reception of data the identifying device of the system checks whether the data belongs to the transmitting machine. In case the data cannot be identified, the game account is reset and incriminated, and the real account owner is searched for by addressing gaming machines of the system. This system, however, can completely upset a player's game in case of system failure which may entail a money loss on player's bank account and decreases the system reliability.

The patent "Game scoring method " (U.S. Pat. No. 4,900,027, Oct. 19, 1988) is known describing a computer-based scoring method in which each player is assigned an identifying digital number entered in conjunction with "WE" or "THEY" key depression, thereafter digital numbers indicating scores earned are entered in conjunction with "WE" or "THEY" key. At the end of a game the computer displays a total score for each individual player together with his identifying number. However, it heavily narrows the possibility of selecting a desirable composition of players for a given gaming situation and provides no privacy of players' accounts. The patent "Method of lookahead pipeline for processing object records in a video system" (U.S. Pat. No. 4,894,774, Jan. 16, 1990) is known. It describes a method that permits to search an associated database list that contains information on all the objects meeting the preset criteria. An associated list of criteria on this or that object is compiled by which the object is searched for among those available, its position and dimensions on the display are specified together with the address of stored graphic data and the address of the communications index that specifies the address of the next entry in the associated list. After that the list is consecutively searched for those entries that satisfy the preset criteria. This method, however, provides no opportunity for a player to select a team that meets his criteria for a given gaming situation and to join the situation together with the desired team of players.

A computerized gaming system for playing poker, described in U.S. Pat. No. 4,926,327, May 15, 1990, is the closest by its engineering essence to the suggested electronic gaming system (EGS). The former consists of a central computer unit (CCU) and a group of individual player consoles (IPC) interconnected with the CCU. The CCU is equipped with means enabling all players to initiate a set of wagers, a circuit to initiate all poker game events with a simultaneous data exchange, a circuit to evaluate each player's cards and determine the order of finish of the players, a circuit to divide the total amount wagered. Each IPC is equipped with a processor, a circuit to receive and display the cards assigned to an individual player, a circuit permitting each player to respond to the game events initiated by the processor, a circuit to receive and display wagering data. The system enables a plurality of players to simultaneously wager within the initiation time period equal to the period a player is permitted to wager. The system provides for a multivariant poker game that complies with the parameters set either automatically by the system or manually by the players. It also performs a final scoring for each player after the game is finished. The system permits to install a plurality of IPCs within a local territory, enables each player to monitor game events, and restricts the surrounding people from observing the game results on the IPC display through use of a funnel-shaped screen. The system can be used in casinos. This computer system, however, can offer players only one type of gaming situation and is limited in territory by the possibilities of a given local network. Besides, it provides no opportunity for establishing a protected network that is unlimited by its territory and can serve all its subjects, both players and companies that require a broad gaming basis enabling them to wager in any combinations, perform money transactions through financial institution once the game is over, etc.

A computerized statistical football game described in U.S. Pat. No. 4,918,603, Apr. 17, 1990 can serve as the closest example of the suggested method of system control and adjustment by its engineering essence. The game has means for setting up individual football franchises, for selecting starting player rosters, for scoring performances for each football player. The invention belongs to gaming systems, being able to control gaming situations depending on variations in football team composition and the process of selection and exchange of football players, as well as the process of scoring performances for each football player after they were exchanged between the teams. This method, however, envisages no possibility for a gaming system user to compose a football team with a guaranteed participation of only those subjects that were identified and checked for their affiliation to the system. Besides, it cannot provide privacy of information on the gaming situation within a selected game and on its final results.

DISCLOSURE OF THE INVENTION

The invention solves the problem of creating an electronic gaming system that provides a broad variety of gaming situations and helps acquire habits of solving logical and strategic problems, betting and forecasting the results of various gaming situations in interaction with other players, for instance, in totalisator or while playing roulette, as well as wagering in gambling combination games the player participates in, like card games, checkers, chess, etc. The system meets the requirement that a player be able to join a gaming situation any time of day or night disregarding the working hours of an establishment, casino for instance, to play several games at a time or to combine playing with other activities without the necessity to leave the premises comfortable to the user and go someplace else. The possibility of betting real money through player's bank accounts that guarantees confidentiality of his wins, accuracy and verifiability of settlements as well as player's personal safety combined with an opportunity to communicate stimulates him to join a game. All the above is realized in a virtual computer world with participation of real players or groups of players selected by the user who can assess them on the basis of the available information. At the same time all the players remain personally unknown to the participants of the gaming situation.

The basic problem of the invention is also solved by devising a method of controlling and adjusting such systems as described above. The operation of computerized gaming systems, for instance, of casino type, requires integration of functionally similar gaming and servicing situations necessary and/or desirable for a player to join such a system. Moreover, it is required that a specific gaming situation be joined only by those of all the system subjects that are registered in the system and have had their honesty checked. The system must prevent a possibility of an intended intrusion and ensure confidentiality of all gaming events and settlements while providing a high invariance level of offered gaming situations and their combinations.

The electronic gaming system consists of a central computer station (CCS), peripheral computer stations (PCS) and a data transmission network (DTN) to interconnect them.

The CCS includes a computer of the administrator and is equipped with the following systems: a players registration system, a game accounts managing system, an information tabulating, storing and searching system, a system for recording gaming situations, a system for final scoring by the results of the game, a wagering and betting system, an executive gaming system, a data exchange system.

The players registration system is designed to register all new subjects who join the system, those already logged on, or those who leave the system. Thus, the system ensures control over a certain restricted group of included subjects.

The game accounts managing system controls the players' game accounts, executes settlements between the players and the CCS and performs operations on their bank accounts.

The information tabulating, storing and searching system serves to accumulate and process the information on players, gaming situations, selection criteria, etc. and keeps special records of communications sessions that permit to check the validity and correctness of administrator actions and the reliability of system protection.

The system for recording gaming situations keeps records on each of the player-initiated games and stores the current gaming situations to permit their restoration in case of a communications failure. Thus, the information in the system is preserved even in case of emergency, enabling a player to check the validity and correctness of settlements.

The wagering and betting system provides a possibility to bet and wager prior to the beginning of a game.

The executive gaming system performs a direct control over the blocks that realize the gaming process, provides information input and output as well as other actions necessary to play a game.

Unlike the state-of-the-art central gaming computers, the CCS comprises an electronic payments system, an information protection system, a secure communications system, a game selection system and a mailing system.

The executive gaming system realizes various gaming situations on the basis of the EGS database.

The secure communications system provides personal communications of PCS with the CCS administrator or with other PCSs by means of electronic communications. The communications can also be organized between any two or more arbitrarily formed PCS groups.

The game selection system includes a database on all the gaming situations and permits to select a game by any preset (indicated) criterion, to join the selection, to participate in several games at a time by switching over from one to another.

The electronic payments system provides information exchange with financial institutions, such as banks, and executes electronic payments by means of telecommunications.

The information protection system protects personal, financial and general network information used by the players against an unauthorized intrusion, as well as demarcation and redistribution of information and information access among the EGS subjects.

The secure communications system provides a direct real-time interactive communications between the system subjects, as well as between a player and the administrator or between groups of players. The system enables a player to overcome the time restriction imposed by working hours of a casino since the latter actually turns into an electronic gaming system.

The CCS and PCSs include mailing systems providing a personal electronic mail for PCSs and/or topical electronic billboards, reference systems and a data exchange system. The reference system supplies information on the players that are present in the EGS, a game rating of each of the potential players and offers an opportunity to select a partner by any of the preset criteria.

The mailing system is designed to provide an exchange of personal messages between the users and other electronic mail services and to update the electronic billboards. Players' personal messages are transmitted in the form of secure packages and can be processed by addressees both in CCS-connected or CCS-disconnected status, since they require no immediate reaction.

The personal E-mail system provides individual correspondence among players, between players and the administrator or other system subjects within the EGS limits. The system also provides topically-grouped in-system electronic billboards. Such a structure ensures a protected information exchange for the subjects included into the system.

The data exchange system provides a protected data exchange between the CCS and PCSs.

The reference system enables a user to easily find the necessary information on the gaming system, thus preventing potential errors on his part that could cause a loss of information or disclosure of his personality. The reference system assists in and simplifies the use of the gaming system.

The PCS comprises modems and computers of the players and those of the financial PCSs. The financial PCSs have their own bank accounts. Optionally, they can be equipped with means of radio communications, modems, network and/or radio modems, desktop and/or laptop computers. The modem and computers comprised in a PCS can be standalone and/or integrated into a LAN with a terminal. Operation of the CCS in the data exchange network permits it to interact with any arbitrary combination of PCS types. The data transmission network consists of a communications station interacting with both radio and network modems.

So, the EGS provides administration, data exchange and execution of gaming processes while ensuring security, privacy and a broad variety of games and services. Moreover, it monitors the players' accounts and will never allow a player to lose more than is deposited on his bank account.

The method of system control and adjustment consists of players registration, selection of a playing team starting composition and scoring each player in a given game.

The distinction of the suggested method lies in the fact that a player is identified at his registration by a set of key attributes that are transmitted to the CCS protection system in an encoded form. The information supplied by a player is individually encoded and sent to the administrator as well as the present (installed) subjects of the EGS. Having registered, the player selects a starting composition of teams (groups). To do so, he gets acquainted with the information search system, selects and directly indicates the required criteria, and passes them on to the CCS which performs an automatic adjustment of the EGS. Then the player joins one or more games selected from the game database list. The player is scored by the results of each game he participates in. In case the set of attributes entered by a player does not coincide with the one stored, a registration failure is registered in the electronic protocol and the administrator is informed thereof. The number of registration attempts is limited, and when it is exceeded, the EGS is warned of an intrusion. In this case the bank and/or other player's accounts are blocked. After the registration the gaming image of the player can be modified on his request in accordance with the suggested common rules. A player can monitor any of the selected games by switching the games over on his display and can interactively influence the regime of the games installed in the EGS.

With games installed, a player can select any information in the process of the game and send it to any subject included into the EGS.

In accordance with the above method, the confidentiality of data transmission, the security of the system and the privacy of bank accounts can be observed by players and the system-included subjects that provide services only when the EGS is comprehensively controlled and adjusted at all stages of its subjects interaction. The above factors are also provided through use of an information encoding system with individual for each player encoding keys in all of his communications sessions with casino programs.

The suggested electronic gaming system permits to establish an unlimited-by-territory closed-for-public network with confidential services open to all of its included subjects, both players and companies. The system offers a broad gaming basis and provides for money transactions by the results of one or several selected games through players' bank accounts.

The suggested method prevents an unauthorized access to the system and guarantees privacy of all actions undertaken in the process of or after the gaming situations that are formulated in accordance with the player's requests together with the team members selected by him.

BRIEF DESCRIPTION OF THE DRAWINGS

The invention is illustrated by drawings that show.

FIG. 2—structure of possible types of peripheral computer stations;

FIG. 3—structure of the data transmission network;

FIG. 4—EGS interaction diagram;

FIG. 5—displayed list of actions for entering the system;

FIG. 8—displayed rating of players;

FIG. 9—table for selecting players by preset criteria;

FIG. 10—displayed scoring table and account information;

INVENTION EMBODIMENT OPTIONS

Figure 1:
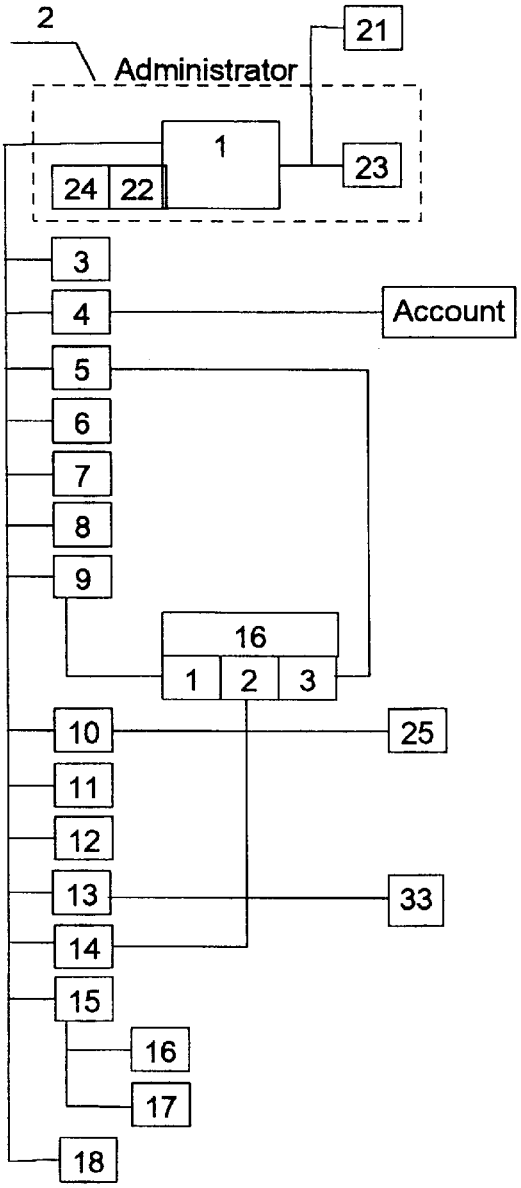
FIG. 1—structure of the central computer station.
Figure 2A:
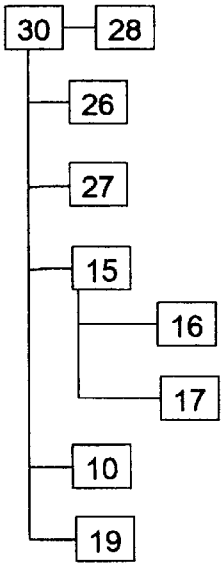
FIG. 2*a*—option 1: a single peripheral computer station.
Figure 2B:
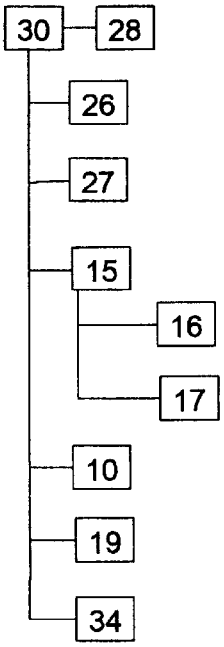
FIG. 2*b*—option 2: a peripheral computer station of financial companies.
Figure 2C:
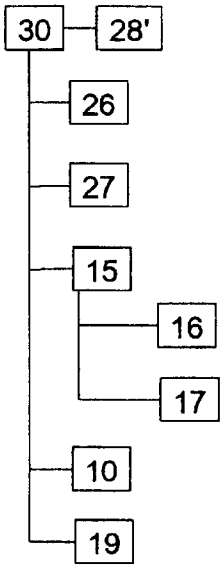
FIG. 2*c*—option 3: a mobile peripheral computer station using radio communications.
Figure 2D:
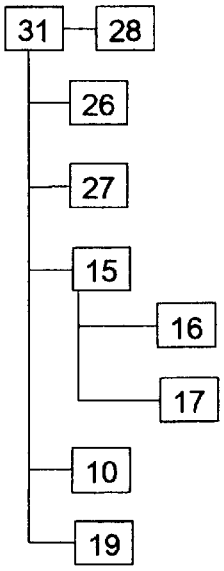
FIG. 2*d*—option 4: a network peripheral computer station.

The electronic gaming system consists of a CCS (1) that comprises a modem device (21), a server (22), a computer of the administrator (23) and a terminal (24), all operating as a single administrative system (2), see FIG. 1.

The CCS structure is a combination of soft- and hardware that stores, collects and controls the information of a computerized gaming system, for instance, of casino type.

The CCS consists of a players registration system (3), a game accounts managing system (4), an information tabulating, storing and searching system (5), a system for recording gaming situations (6), a system for final scoring by the results of the game (7), a wagering and betting system (8), an executive gaming system (9), a data exchange system (10), see FIGS. 1, 2*a–d*.

The EGS is equipped with peripheral computer stations (PCS) (25) that comprise a system for admitting players (26) to the CCS and a gaming interface system (27), see FIGS. 2*a–d*.

Unlike the state-of-the-art central gaming computers, the CCS (1) also comprises an electronic payments system (11), an information protection system (12), a secure communications system (13), a game selection system (14), an executive gaming system (9). The CCS realizes the gaming situations from the database (16') of the executive gaming system (9), see FIG. 1. The interaction between the CCS (1) and a PCS (25) is carried out through a data transmission network (32), see FIG.4, comprising a communications station (20) that can communicate both with radio modems (28'), see FIG. 2*c*, and network modems (28), see FIGS. 2*a,b,d*. The EGS can also feature, for instance, mailing systems (15), see FIGS. 1 and 2*a–d*, that are included into the CCS (1) and PCSs (25).

The EGS can, for instance, have either a single a secure communications system (13) or a secure communications system combined with a mailing system (15). The a secure communications system provides electronic communications of a PCS with the administrator computer (23) at the CCS (1), or communications of PCSs (25) among themselves, see FIG. 4. The a secure communications system (13) can provide communications of any two or more arbitrarily formed groups (29) of PCSs (25), see FIG. 4.

Figure 6:
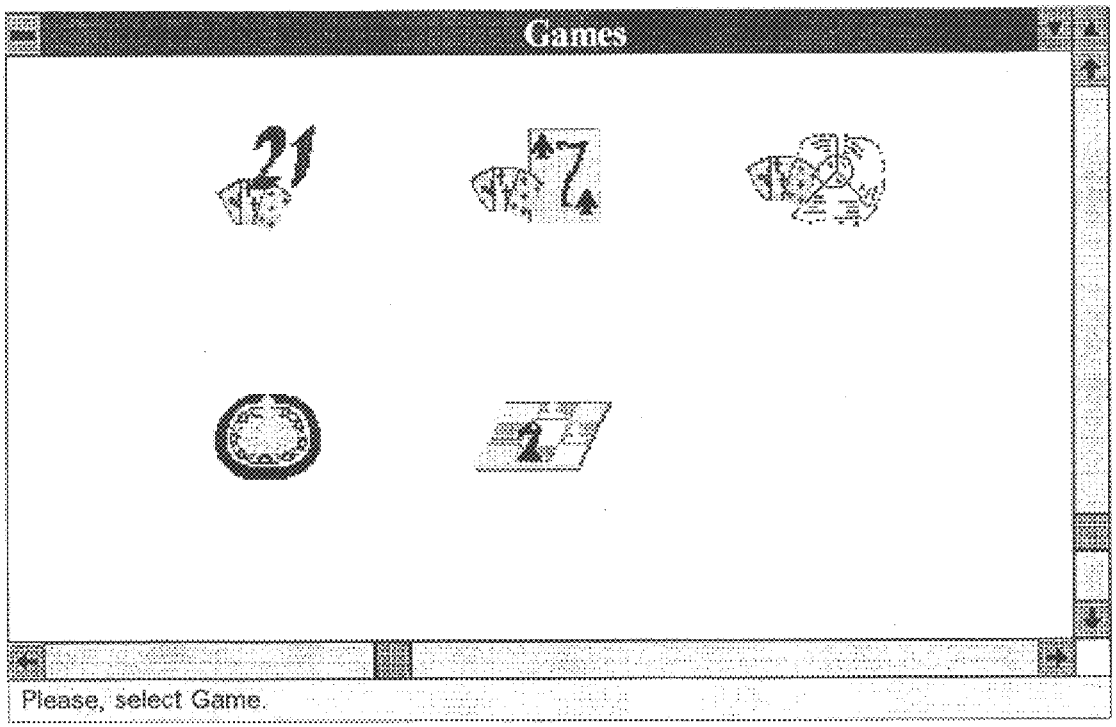
FIG. 6—displayed structured information from the game selection database.

The game selection system (14) comprises a database (16") that describes all types of gaming situations and permits selection of any of them, see FIG. 6.

The information tabulating, storing and searching system includes a database (16") that describes the composition of players and their rating, and permits to select players by any preset criterion, see FIGS. 8, 9. The PCS includes computers (30) or a computer network (31) and modems (28) of both players and bank and/or other deposit accounts, see FIGS. 2*a–d*. The CCS consists of a terminal (24) and a server (22) of the administrator (2), connected to a modem device (21), see FIG. 1. The CCS (1) provides interaction of PCSs (25) in any arbitrary combination through the data transmitting network (32). The PCS (25) includes a modem (28) and computers (30, 31) that can be both desk- and laptop. The computers included into the PCS (25) can be either standalone, see FIG. 2*a*, or connected to a LAN, see FIG. 2*d*, having a terminal and a modem (28), see FIG. 2*d*.

All the systems operate in an interactive mode and are based, by the general classification, on methods of comparison, classification and identification of images (MCCII) that treat comparison as a measuring operation performed by a measuring and computing complex (MCC). The MCC has an hierarchic structure since each system solves its own problem, independently classifies a specific action with this or that type of problem, and interactively passes its decision to an appropriate system. The EGS adequately identifies and organizes the operation of the whole system performing the role of an MCC using MCCII, collects and processes the data obtained as a result of a complex examination of the situation. When necessary, the main gaming functions can be set by a player during a game, or by the administrator in the administrative mode of system operation. A model formulated in terms of fuzzy logic is applied to use the database. Using the rules for composing fuzzy relationships, a diagnostic decision for each data set is worked out that assumes the form of an affirmation, negation or question on further gaming process when applied to the most suitable variant. Versions of such a system are known from publications, for instance, А.С.Клешеев, М.Ю.Черняховская. Системы представления проблемно-ориентированных знаний [Systems for problem-oriented knowledge representation]. Известия АН СССР, 1982, N 5, сс. 43–63.

The database is represented by a set of data organized by the SDSA (structured description of subject area) principle with each set physically located as a separate system on the disk(Н.Т.Рустамов, Г.Т.Ибрагимов. Описание инструментальных средств для построения советующих распознающих систем [Description of tools for constructing advising identification systems]. УЭНПО «Кибернетика», АН СССР, Ташкент, 1991 г).

Formal language means are used for administrative-type information systems, for instance "DESKTOP SYSTEM" (С.П.Ботуз..Методы и средства отображения многомерных параметрических зависимостей [Methods and means for representation of multi-dimensional parametric dependencies]. Сб.науч.трудов:Информационные технологии искусственного интеллекта.. М:ГосИФТП, 1994г.,УДК 681.51\513.2).

Figure 11:
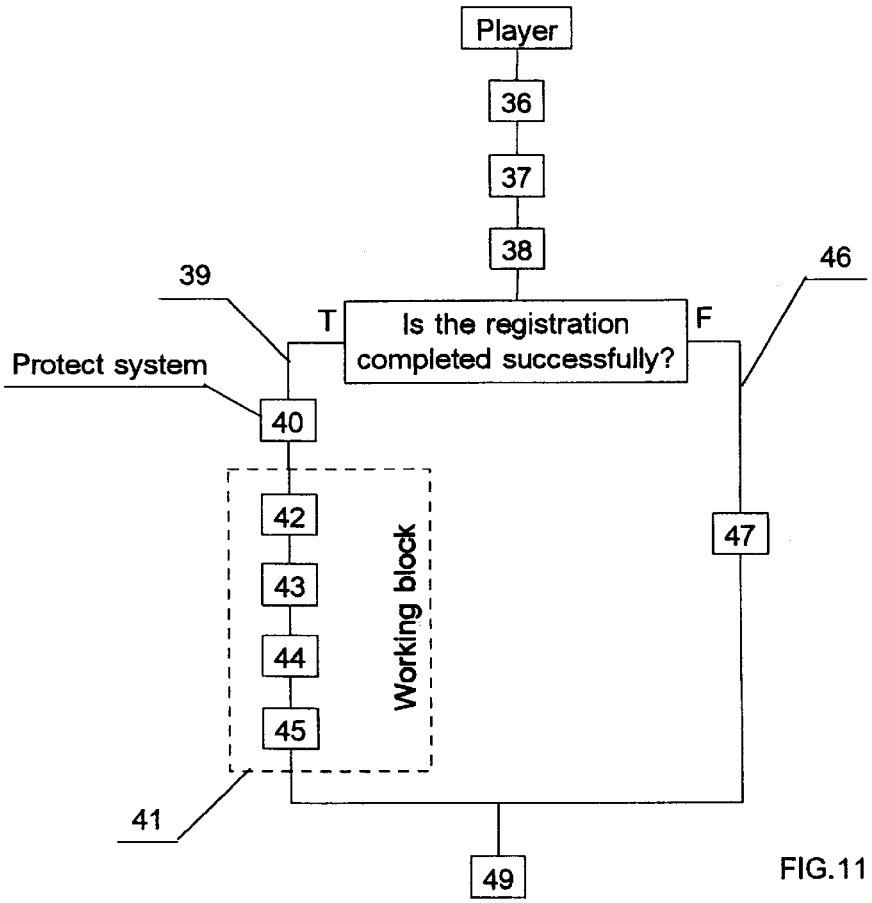
FIG. 11—diagram of the sequence of system-controlling actions.

To realize the suggested method of system control and adjustment, each player, who wishes to participate in the system, performs the following operations from his peripheral computer station (PCS) (25) through a telephone line: activates (36) the PCS, establishes connection (37) with the central computer station CCS (1), starts the player registration system (38), see FIG. 11. Each player has a bank and game deposit accounts (34) included into the EGS, as well as his permanent and operational identifying attributes (code, encoding key, password, pseudonym, gaming image) logged in the system. In order to join the system, a player must have a computer connected through a modem to a telephone line and a special software. A physical connection with the GCS, followed by an automatic connection through the telephone line to the CCS (1), is established by registration, see FIG. 11. If the registration is successful (39), the GCS monitor is activated (40) and interaction with the working block of the system (41) becomes possible. The player receives the necessary information (42) from the reference system, selects a game he is interested in (43) and controls the gaming process (44). All the financial settlements resulting from the game are performed by the system (45). In case of a registration failure (46) the PCS is blocked (47), and the system provides an opportunity to personally address (48) the administrator by connecting the player with the administrator, see FIG. 11. At this point the player's registration session is stopped.

Figure 12:
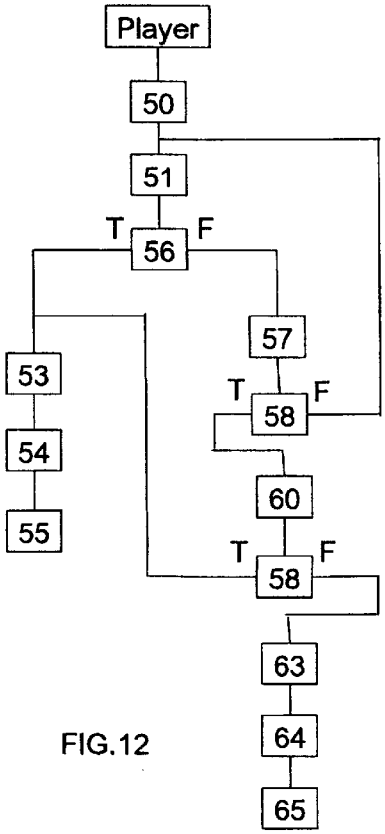
FIG. 12—diagram of the players registration mode.
Figure 13:
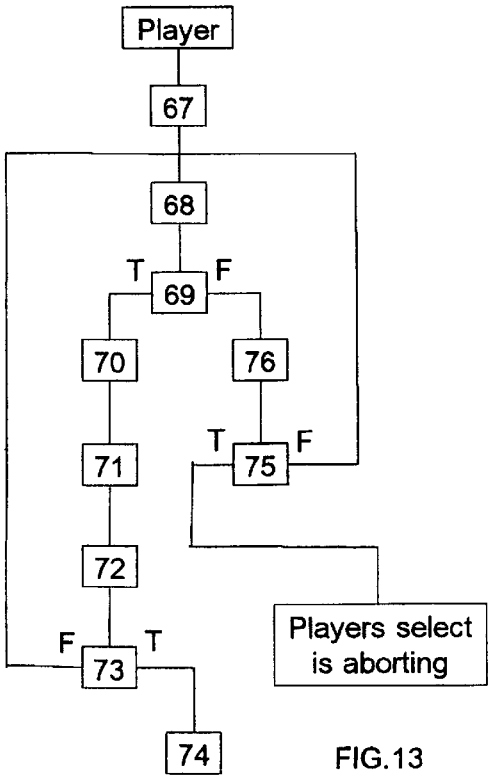
FIG. 13—diagram of the starting players composition selection mode.

To accomplish registration, see FIG. 12, a player activates the registration system (50) by clicking a corresponding item on the PCS-displayed menu and enters, upon request, his identifying attributes (51), i.e. his code, password and pseudonym, in sequence. The registration system compares the received information with the identifying attributes stored in the CCS database. If they coincide (52), a successful registration (53) is logged in the electronic protocol, player's business cards are sent to his constant partners and the administrator (54), and the player is connected to the working block to perform all further actions. Thus, the registration procedure is successfully completed (55). A special system for encoding information with an individual for each player encoding key is used to provide security and privacy of communications between a player and the casino.

If the identifying attributes do not coincide (56) with those stored in the CCS database, the attempt is logged in the electronic protocol as a registration failure (57) and is compared with the number of allowed attempts (58). If the number of attempts is exhausted (59), the player is urgently connected to the administrator (60) for a dialog. After the dialog the CCS sends a request "is the personality of the player identified?"(58). If the answer is "yes" (61), a successful registration of the player is automatically logged in the protocol (53), and he is connected to the working block (41). If the answer is "no" (62), an intrusion attempt is logged (63), the player's account is blocked (64) to prevent theft of money. The registration is aborted (65).

Figure 16:
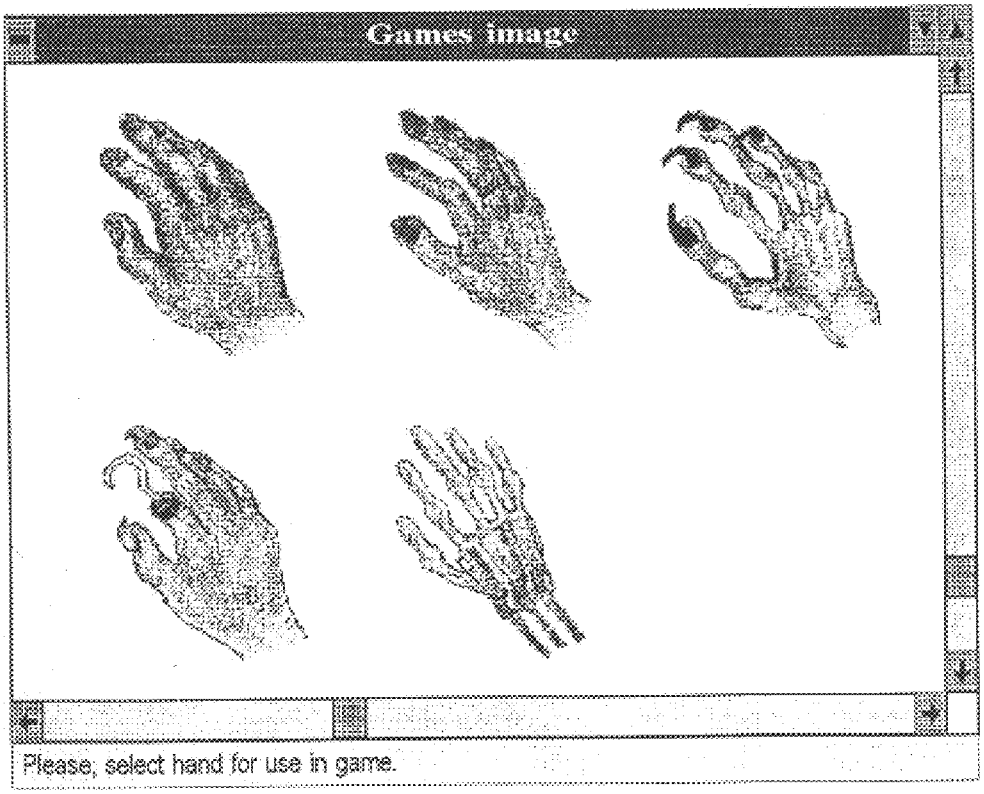
FIG. 16—displayed "images" of players.

In case the number of registration attempts is not exhausted (66) the player enters his identification attributes once again (51). If the registration was accomplished successfully, the player can use the registration system for changing his identifying attributes—pseudonym, password, see FIG. 5, and his gaming image, see FIG. 16. The player's pseudonym and gaming image can be changed in strict compliance with the preset rules which protects other players against fraud. The player's password can be changed at his will by selecting an arbitrary combination of numerals and letters, both Latin and Cyrillic, or any other characters offered by the computer keyboard.

The registration system is also actuated to log a player's temporary exit from the casino or his final quitting of the system. In such cases appropriate mandatory entries are logged in the protocol and the CCS database. Any data exchange in the EGS is performed through information protection means (12) that encode and decode the information in players' computers.

After a player is connected to the working block (41) in the protected display mode, he can actuate any mode of this block and switch over between several modes. A player can switch over to information or gaming mode, start one or several games, or start selecting players for his team.

Figure 7:
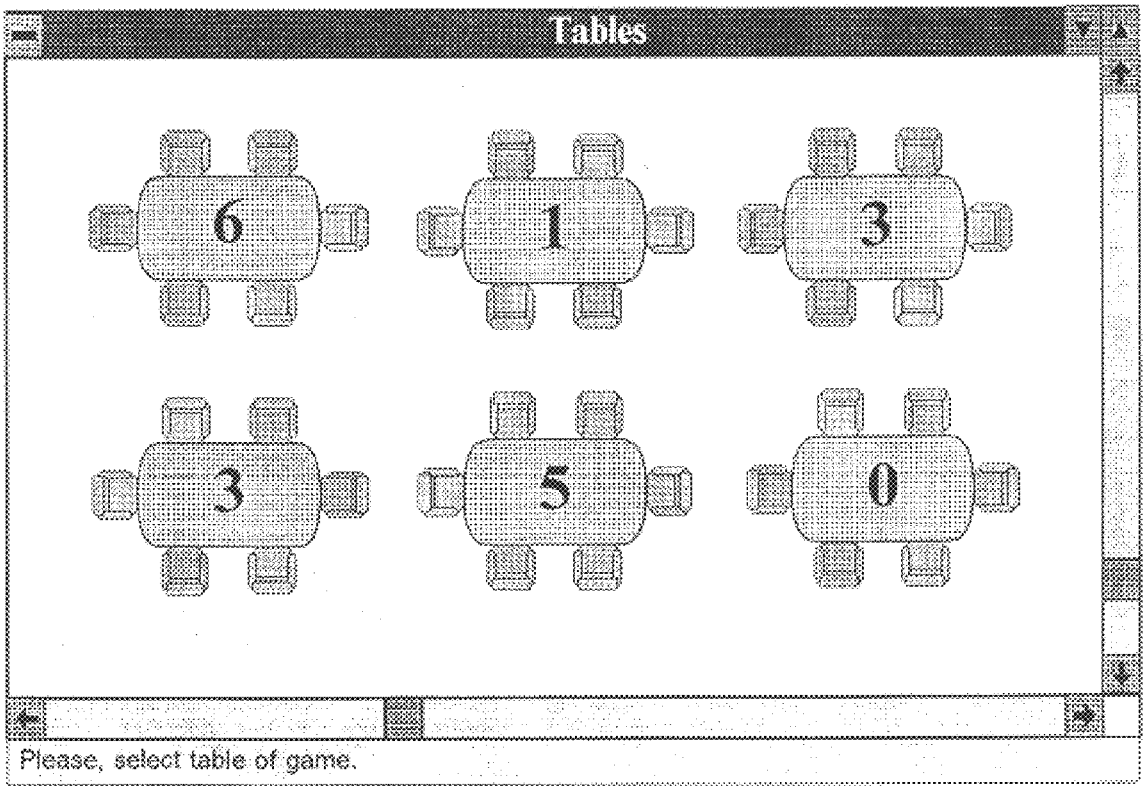
FIG. 7—displayed structured information for selecting players.

In the players searching mode the user actuates the search system (67), specifies his criteria (68) and receives a request "are needed candidatures available?" (69). If the answer is "yes", he can select his partners from the list (70). Then the player's business cards are sent to the selected persons (71), and the partners enter a dialog exchange (72) to specify the criterion of the initiator, for instance, what gaming table the initiator would like to join, see FIG. 7, or what players by pseudonym, gaming image or rating he is willing to invite, see FIG. 9. Then the system requests "do all partners agree?" (73). If the answer is "yes", the team is considered to be formed (74). If the answer is "no", the system requests "abort players selection?" (75). If the answer is "yes", the selection process is stopped. If the answer is "no", the system repeats its request "do all partners agree?" (73). The required rating of players can be either assigned by the initiator himself or can be chosen by him from the players rating table, see FIG. 8, offered by the information system (42). The rating is selected by a probability percent of partner's wins in a specific type game. If the EGS contains games with the specified criteria, the system offers the list of games and the game selection process starts (77), see FIG. 14. Prior to the start the player selects his partner by clicking the required line, see FIG. 9. The latter receives the player's business card, and then the partners enter a dialog information exchange (72). If the EGS contains no players meeting the set criteria, the initiator sends his invitations to those present (76) and then decides whether to stop partners selection or not.

Figure 14:
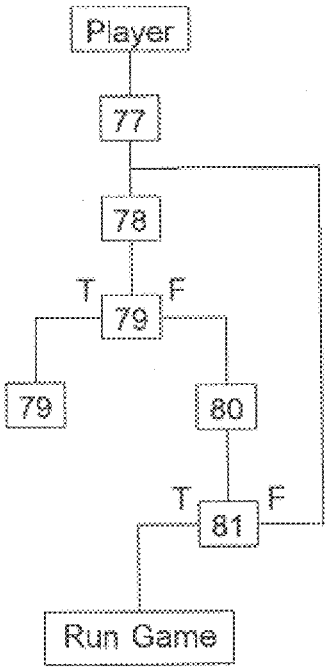
FIG. 14—diagram of the game joining and monitoring mode.

To select a game, see FIG. 14, the player initiates the game selection process (77), selects a game among those offered (78), see FIG. 6, and receives a request "is the game active?" (79). If the answer is "yes", the player joins the specified game (79*a*). If the answer is "no", he is prompted to start the players selection mode (80) followed by a request "is the team formed?" (81). If the answer is "yes", the game starts, if "no"—the game selection procedure is repeated (78).

Figure 15:
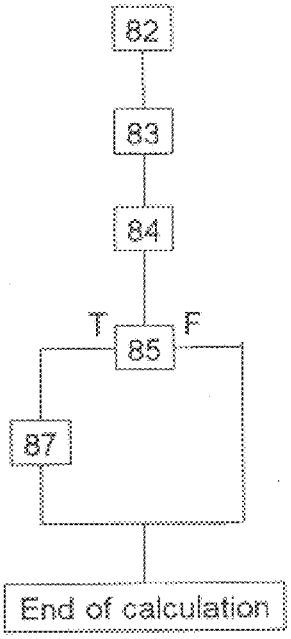
FIG. 15—diagram of player account management and settlements.

After the game is finished each of the players is scored and their accounts are settled, see FIG. 15. This is done by summing up the points earned during the game (82), converting them into a money equivalent (83) and entering the wins and losses into players' accounts (84). In this case the player receives a request "are bank accounts activated?" (85). If the answer is "yes", electronic payments through banks are executed (86) to accomplish the settlements. If the answer is "no", a corresponding payment line is displayed for the player, see FIG. 10. Thus the settlements are accomplished.

The EGS operates as follows: to initiate the EGS, each system subject has to go through the registration procedure by entering his code, pseudonym and password. After the data is entered the player is assigned a registration number with his identifying attributes logged in the CCS. Using his PCS, a player can enter the system through a telephone line any time of day suitable to him. Connection to the system is accomplished by starting one of the programs of the players registration system that dials through a modem the casino phone number and connects to the casino administrator computer. After the connection is established the registration system requests the player to enter his pseudonym, password and code, see FIG. 5. Then the system compares the input data with the player's identifying attributes stored in the administrator computer. If they fully coincide, the customer is considered identified and is given the opportunity to use his deposit account that can be either a game or bank account. To perform specific gaming actions, a player chooses a game pseudonym by requesting appropriate data from the information tabulating, storing and searching system through the PCS interface, see FIG. 5, selects the gaming team by entering appropriate data into the EGS through his PCS interface, see FIGS. 7, 8 and 9, selects his game by entering appropriate data into the game selection system through his PCS interface, see FIG. 6. To form a desired gaming team, a EGS user sends a request or an advertisement to the mailing system or uses for this purpose other EGS communications systems. To preserve safety and confidentiality, all information exchange between the CCS and a PCS, and among the PCSs is protected by the information protection system, by security means of the data exchange system and—when settling accounts—additionally by security means of the electronic payments system. Each system uses a specific numeric identifier for each player. To perform all the necessary actions, a player gets acquainted with the rules and prompts stored in the reference system. After the game is over, the player's PCS interface displays a table with the results of the game and the operations performed on his deposit account, see FIGS. 10, 2*b*.

The game selection mode (see FIG. 14) requires the following actions: the player initiates the game selection system (77) that displays the available games through the player's PCS and permits him to select one (78) by clicking it. Partners can be selected either before or after this procedure. So, after the game is installed, the players selection mode is initiated by starting the players search system (67), or the player switches over to join the selected game (79).

Throughout his presence in the EGS a player can dynamically switch over between different activated games and modes, and/or participate in one or several games at a time. The player can either monitor a gaming process or join it in an interactive mode. A player is also offered a possibility to wager or place bets with other players before the game starts or to monitor the process of scoring the points by the game results. All gaming events are logged in the recording system of the EGS. The scoring of points, see FIG. 15, is done throughout the gaming process, with its results reflected in the player's game deposit account. After the game is over the account managing system converts the scored points into a money equivalent and the resulting sum is either added or subtracted from the player's bank account deposited with the EGS, provided the account was activated prior to the start of the game. After that electronic payments with the bank are executed (87).

So, each system user can play with any other user of said system at any time with an option of simultaneous participation in several games, and settle accounts by the results of the game through his bank without the necessity to abandon his current occupation.

A player does not have to leave his office or home and is not restricted by the casino working hours, i.e. he can play any time of day or night. Games are played anonymously with full privacy of data in the system and system protection against intrusion provided. Accounts are settled at will either in conventional points or by cashless operations with bank accounts, thus increasing security and forbidding a player to loose more money than is deposited on his account. All gaming events are logged, thus enabling a player to check the validity of all gaming actions and preventing possibility of fraud.

INDUSTRIAL APPLICABILITY

The invention can be successfully used for modeling real interrelationship among subjects of free market economy. The method of system control and adjustment relates to electronic network systems that use programmable control. The suggested gaming system can be applied for computerized modeling of real interrelationship among subjects of free market economy after the information pertaining to the processes to be modeled and a list of possible situations are entered into the system database.

What is claimed is:

1. An electronic gaming system comprising:

a central computer station including:

an administrative subsystem including an administrator computer for administrative personnel to administer the electronic gaming system, a players registration subsystem coupled to said administrative subsystem for registering all current players, a game accounts managing subsystem coupled to said administrative subsystem for managing the players' accounts and performing transactions with the players' bank accounts, an information tabulating, storing and searching subsystem coupled to said administrative subsystem for processing information pertaining to the players and gaming situations, a game recording subsystem coupled to said administrative subsystem for recording gaming situations, a scoring subsystem coupled to said administrative subsystem for scoring by the results of a game, a wagering and betting subsystem coupled to said administrative subsystem for enabling players to place wagers and bets pertaining to a game, an executive gaming subsystem coupled to said administrative subsystem, said executive gaming subsystem including a database that is accessed to realize and control gaming situations, an electronic payments subsystem coupled to said administrative subsystem, an information protection subsystem coupled to said administrative subsystem for protecting any data exchanged within the system by encoding/decoding the exchanged data, a secure communications subsystem coupled to said administrative subsystem for preventing unauthorized access to communications within the system, a game selection subsystem coupled to said administrative subsystem for enabling a player to select a game in which the player wishes to participate, and a data exchange subsystem coupled to said administrative subsystem for enabling the administrative subsystem to exchange data with other system components;

a data exchange network including a communications station coupled to said data exchange subsystem of said central computer station; and a plurality of peripheral computer stations coupled to said central computer station through said data exchange network, each of said peripheral computer stations including a subsystem for admitting and registering players with said central computer station, and a gaming interface subsystem.

2. The electronic gaming system as defined in claim 1, wherein said central computer station and said peripheral computer stations include mailing subsystems.

3. The electronic gaming system as defined in claim 1, wherein said secure communications subsystem comprises a personal communications subsystem.

4. The electronic gaming system as defined in claim 3, wherein said peripheral computer stations are connected by electronic communications with said administrator computer and are connected between each other through said personal communications subsystem.

5. The electronic gaming system as defined in claim 4, wherein any two or more arbitrarily formed groups of said peripheral stations are interconnected by electronic communications through said personal communications system.

6. The electronic gaming system as defined in claim 1, wherein said game selection subsystem includes a database having data for describing and selecting different types of gaming situations in any combination of games for players.

7. The electronic gaming system as defined in claim 6, wherein said information tabulating, storing and searching subsystem includes a database having data for describing and forming players teams and players rating by any preset player criterion.

8. The electronic gaming system as defined in claim 1, wherein said information tabulating, storing and searching subsystem includes a database having data for describing and forming players teams and players rating by any preset player criterion.

9. The electronic gaming system as defined in claim 1, wherein said peripheral computer stations include computers and modems for both players and bank and/or other deposit game accounts.

10. The electronic gaming system as defined in claim 1, wherein said central computer station further includes consists of a terminal and a server of said administrative subsystem connected to a modem device.

11. The electronic gaming system as defined in claim 1, wherein said peripheral computer stations are interconnected in any arbitrary combination by means of said central computer station and a data transmission network.

* * * * *